US006869075B1

(12) United States Patent
Stavinsky

(10) Patent No.: US 6,869,075 B1
(45) Date of Patent: Mar. 22, 2005

(54) GAME METHOD FOR A BLACKJACK-TYPE GAME

(76) Inventor: Emil Stavinsky, 6676 Boxwood La., Las Vegas, NV (US) 89103

( * ) Notice: Subject to any disclaimer, the term of this patent is extended or adjusted under 35 U.S.C. 154(b) by 0 days.

(21) Appl. No.: 10/391,403

(22) Filed: Mar. 17, 2003

Related U.S. Application Data

(60) Provisional application No. 60/365,679, filed on Mar. 18, 2002.

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS 5,013,049 A * 5/1991 Tomaszewski ..... 273/292
5,407,209 A * 4/1995 Prerost ..... 273/292
5,713,574 A * 2/1998 Hughes ..... 273/292
5,944,314 A * 8/1999 Stavinsky ..... 273/292
5,988,643 A * 11/1999 Awada ..... 273/292
6,575,466 B1 * 6/2003 Lizak ..... 273/292

* cited by examiner

*Primary Examiner*—Benjamin Layno
(74) *Attorney, Agent, or Firm*—Robert Ryan Morishita; Anderson & Morishita, LLC

(57) ABSTRACT

Improved Blackjack-style games are set forth. In one embodiment, the player and dealer are dealt at least two cards and can discard and exchange one of the cards to make a final hand. In another embodiment a trump card is used to resolve pushes. The trump card can also be used for designating certain jackpot awards. In still another embodiment, face cards of Jacks through Kings are assigned values other than the traditional value of 10. In another embodiment, losing player wagers are inventoried and either recaptured or lost based upon the outcome of the subsequent hand. In another embodiment the player makes two wagers and plays a traditional Blackjack hand. To resolve the second wager the player's hand receives additional cards (if necessary) to have at least five cards representing a winning or losing Stud Poker hand.

9 Claims, 1 Drawing Sheet

GAME METHOD FOR A BLACKJACK-TYPE GAME

CROSS-REFERENCE TO RELATED APPLICATION

This application is a provisional conversion application of and claims priority to commonly owned and prior filed provisional patent application Ser. No. 60/365,679 filed Mar. 18, 2002 and titled "Improved Game Method and Device For a Blackjack Game"

FIELD OF THE INVENTION

The present invention relates to methods for playing Blackjack-type casino games.

BACKGROUND

Blackjack, also known as "21", is popular and has been played in casinos for many years. The rules of the game of Blackjack are well known to those skilled in the art.

The rules, with a few exceptions, are fairly universal. Some alternate rules of the basic Blackjack game require the dealer to hit a soft 17 (a hand count according to the rules of Blackjack of 17 including an Ace which counts as one or eleven), limit the hand counts to which a player can double down to ten or eleven, and limit the number of times a hand can be split are but a few examples. These alternate or modified rules are well known as well.

Recently, Blackjack-type games such as SPANISH 21® described in U.S. Pat. No. 5,615,888 issued Apr. 1, 1997 to Lofink et al the disclosure of which is hereby incorporated by reference, have been created. Some of these games include the feature of an additional or side wager to fund and participate in a jackpot feature for the game based upon the player's hand. In these games the side wager is optional and is not mandatory.

As hereinafter used, the term Blackjack or Blackjack-type or Blackjack-style game refers not only to the basic Blackjack game with its variations but also the aforementioned and other games which are like Blackjack.

Other variations include that described in Le Vasseur U.S. Pat. No. 5,257,789 where a player can play a single hand against multiple dealer's hands and String U.S. Pat. No. 5,649,705 where a player can elect to wager upon whether the player or dealer will obtain a winning hand.

These Blackjack games are banked by the house (e.g. casino). This means that the player is playing against the dealer who represents the house (casino). Wagers are paid to a player having a winning outcome by the dealer (the "house") and losing wagers are collected by the dealer for the house. Further nearly all winning outcomes are paid at even money, i.e. 1:1, except for a Blackjack (an Ace with a ten value card) which typically pays 3:2.

It has also been known to incorporate Blackjack into gaming devices, handheld novelty games and computer games. These Blackjack game are based upon the traditional rules of Blackjack; but may often provide, for a casino wagering game, a pay out of only 1:1 to the player for a Blackjack to provide a vigourish to the casino.

In a heretofore unrelated game which is the subject matter of my prior U.S. Pat. No. 5,944,314 issued Aug. 31, 1999 and titled "Method For Playing a Card Game" I introduced the concept of a trump suit, as suggested in card games such as Bridge, into a new casino game.

Players can become bored with traditional Blackjack. Accordingly there is a need for a new and improved Blackjack-type game for play in both a live, table game, format and electronic version for Internet, novelty game, computer game and electronic machine play.

SUMMARY OF THE INVENTION

There is, set forth according to the present invention, various improved methods for the play of Blackjack-style games. In one embodiment, the method includes dealing of at least two cards to each player and the dealer. Each player completes their hand to a final holding by one of the following steps (i) passing wherein the player will use the initial cards as his final holding, the summed values of the cards defining a final player hand value or (ii) swapping wherein the player discards at least one of his initial cards and receives a replacement therefor defining the final holding, the summed values of the cards defining a final player hand value: The dealer competes his hand to a final value by (i) exposing his face down card defining a final hand, the summed values of the cards defining a final dealer hand value and (ii), if the initial cards have a summed value less than a predetermined sum, the dealer swapping the lowest value card for a dealt replacement card to define a final holding, the summed values of the cards defining a final dealer hand value; The dealer and player final hand values are compared and (i) if the dealer has a higher final hand value, the player losing his wager(s), (ii) if the player has a higher hand value, issuing an award to the player and (iii) if the player's final holding is a pair of Aces, issuing the player a greater award.

In another embodiment, the game of Blackjack is improved by, when a player loses a hand, the lost wager is inventoried to a designated area. If the player loses the next hand, the inventoried wager is lost. If the player wins the next hand the inventoried wager is returned to the player. Thus the player must lose two consecutive hands to lose the inventoried wager.

In another improvement, a card is displayed the suit of which defines a trump. Based upon the trump cards in a player and dealer hand, pushes-may be resolved in favor of the player or the dealer. Player hand holdings of cards of the trump suit can also be used to provide for increased or a side award to the player.

In still another embodiment, Jacks though Kings are assigned point values based upon a preselected criteria of Jack=X Queen=X+1

King=X+2 and $2 \leqq X \leqq 5$.

In still another embodiment, upon complection of the traditional Blackjack hand, the player's hand receives additional cards (if required) to have a holding of at least 5 cards which represent a Stud Poker holding. Based upon the holding the player may receive an additional award.

BRIEF DESCRIPTION OF THE DRAWINGS

These and other features and advantages of the present invention will become appreciated as the same becomes better understood with reference to the specification, claims and drawing wherein

DESCRIPTION

Figure 1:
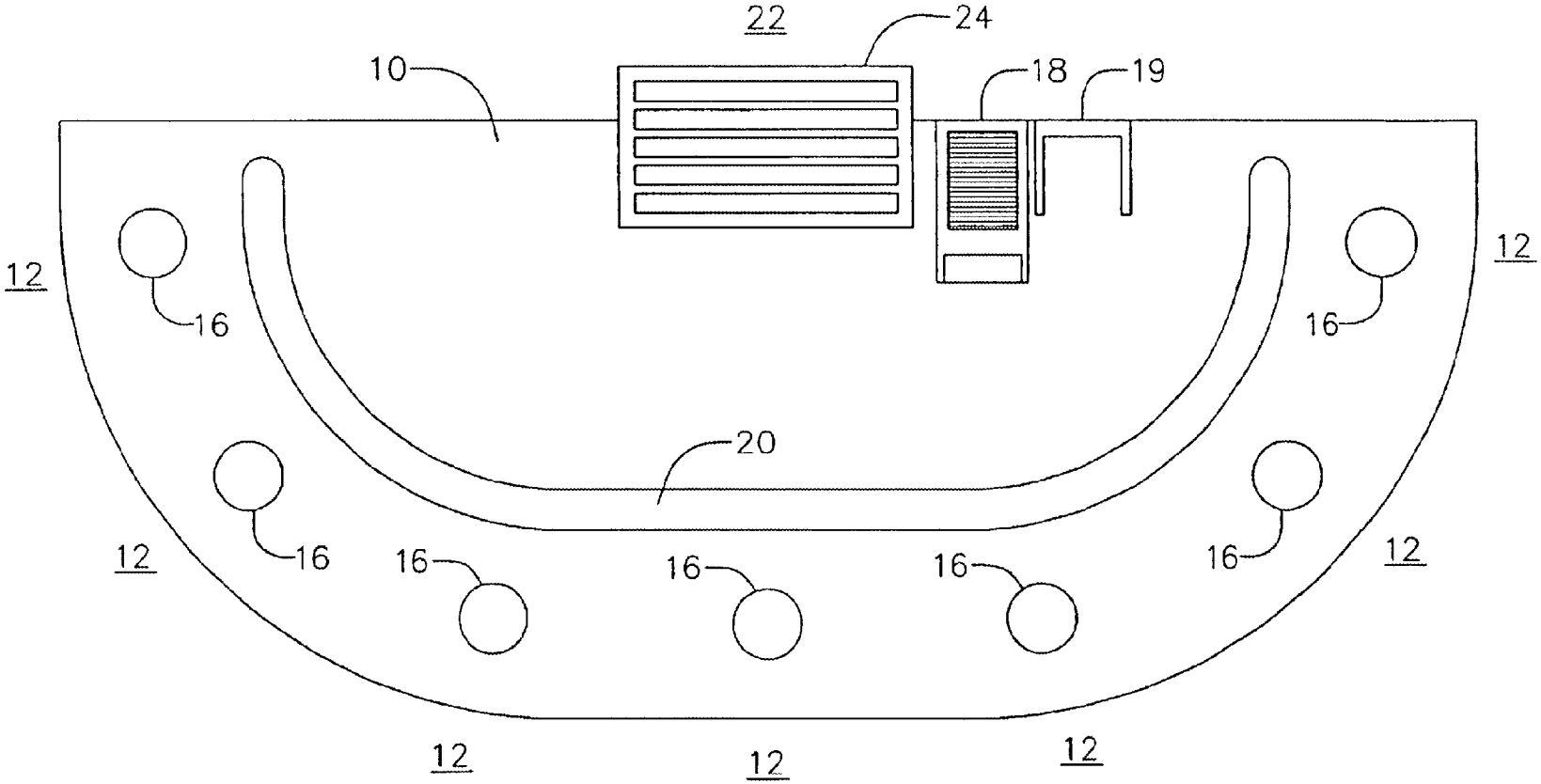
FIG. 1 shows an example of a layout for the play of a Blackjack-style games according to the present method.

Broadly, the present invention is directed to a modified Blackjack-style game in either a live, table game, format or in an electronic format such as for play on a gaming machine, a computer game, a hand-held, electronic novelty game, a digital table game, for play of the game in connection with a game show or for play over the Internet.

Referring to FIG. 1, a table layout 10, upon which the modified Blackjack game of the present invention is played, is schematically shown. The layout is preferably mounted on top of a conventional type gaming table (not shown). A plurality of player locations 12 are provided along the periphery of the table. Typically, there are seven player locations. Each of the player locations 12 has a designated areas associated therewith shown as betting areas 16. A dealer's location 22 is provided and has a chip rack 24 to contain the chips paid and collected during the play of the game. The cards for the play of the game may be dealt by hand from single or multiple decks of standard playing cards or may be dealt from a shoe 18. Adjacent the shoe 18 may be a trough 19 to collect and stack cards "burnt" from the initial shuffle or the cards spent during play of multiple hands.

Also shown in FIG. 1 for the play of one embodiment of the game as hereinafter described, is a decision area 20 positioned between the player positions 12 and dealer area 22.

The various embodiments of the game will now be described.

Double Aces 22/No Bust

According to this embodiment of the game, to participate, each player sits at a player position 12 and places a wager in the wager area 16, The amount of which may be dictated by table minimums and maximums. After all participating players have made their wagers, the dealer deals two cards to each player and two cards to himself defining, respectively, an initial, two card, player holding and dealer holding. Preferably, the player's initial holding is dealt with both cards face up and the dealer's initial holding dealt with one card face up and the other card face down. However the player's initial holding may be dealt face down as well.

Before discussing the player's and dealer's actions to complete their hands, it should be noted that the playing cards according to this embodiment have the following values:

| | |
|---|---|
| Aces | 11 points |
| 10–Kings | 10 points |
| 2–9 | face value (pip count) |

After each player has received their initial holding, each player in order has several options according to the present invention. First, the player can sum the cards of the initial hand and opt to "Pass" whereupon the summed value of the player's initial cards become the player's final hand value. The player can, in the alternative, opt to "Swap" one of the cards, preferably the lowest value card of the initial holding, for a replacement card. That is, the player can opt to swap, i.e. discard, a three and receive a dealt replacement card. The point value of the replacement card is summed with the non-swapped card to define the final value for the player hand.

In the even the player's initial holding are two cards of like value, e.g. two 8's, the player can "Split" the hand. To take this action the player places a second wager, preferably in the same amount as the first wager. To indicate the exercise of the split option, the player may separate the two cards and position one adjacent to each wager. The dealer then deals the player one additional card. The additional card is commonly summed individually with each of the cards of the initial holding to define two player final value hands of the same value. In the example above where the player is dealt two 8's and splits them and is dealt a 7, the player would have two hands each with an 8 and a 7 and defining player final hand value of 15.

After each player has completed their hands, the dealer exposes his face down card and completes his hand. In the event that the value of the dealer's initial card holding is below a predetermined value, e.g. 16 or less, the dealer is required to swap the lowest value card for a drawn, replacement, card. For example, if the dealer's initial holding were a 6 and a 9 (summed value of 15), the dealer would swap, i.e. discard, the 6 for a replacement card, e.g. a 10 value card, for a dealer's final hand value of 16. If the dealer's initial two cards have a summed value above the predetermined minimum, e.g. 17 or higher, the summed value of the two cards of the dealer initial holding define the dealer's final hand value.

The dealer then, in order, compares the player final hand value with that of the dealer. If the dealer has a higher hand value, the dealer is the winner and the player's wager(s) are collected. Conversely, if the player's final hand value is greater than the dealers, the player is declared the winner and is paid an award such as a payment of 1:1 on his wager(s). If the dealer's and the player's final hand values are the same the hands are declared a push and the player's wager is neither paid of collected by the dealer.

As an added feature, where the player's initial holding consists of a pair of Aces (player final hand value of 22), the player is paid an enhanced reward such as 2:1 on his wager(s).

After all of the player's hands are resolved and all wager's paid/collected, the dealt cards are collected and placed in the trough 19 and the player's are invited to place new wagers for the next hand.

Three Card 21

This game is akin to the previous game method; however each player and the dealer receive an initial holding of three cards. At least one and preferably two cards of the dealer's initial holding are dealt face down.

Upon examination of the player's initial holding, the player can opt to Pass (the summed values of the initial holding become the player's final hand value) or Swap (discard the lowest value card for a replacement card, whereupon the summed value of the two cards of the initial holding and the replacement card define the player's final hand value).

The dealer now exposes his face down card(s). If the sum of the card values of the initial holding is less than a predetermined number, for example 16 or less, he is required to Swap his lowest value card for a replacement card and sum the value of the replacement card with the values of the non-swapped cards to define the dealer's final hand value. If the sum of the values of the cards of the dealer's initial holding is greater than the predetermined number, e.g. 17 or greater, then the sum of the values of cards of the dealer's initial holding defines the dealer's final hand value.

As in the previous embodiment, the dealer compares the dealer's final hand value with that of each player. If the dealer has a higher final hand value than the player, the player loses their wager which is collected by the dealer. If the player has a higher final hand value, the player is the winner and is paid an award such as 1:1 on their wager. If the hand values are the same it is a push and draw and the player neither wins or loses their wager.

In the event the player's initial holding has a hand value of a predetermined sum, e.g. 21, the player may be paid an enhanced award such as 2:1 on their wager.

Decision Line 21

With reference to FIG. 1, the decision area 20 is used in the manner described herein.

According to this embodiment, cards are valued according to the traditional rules of Blackjack, where Aces have a value of either a "1" or an "11". Alternatively this variation may be incorporated into any of the game methods described above.

Players make wagers to participate in the game in the traditional fashion. The decisions, e.g. stand, hit, double-down, split according to the rules of Blackjack as well as the resolution of hands, also according the rules of Blackjack, are followed resulting in, for each player, a winning outcome, a losing outcome or a push outcome.

According to the present invention, in the event the player has a losing outcome, the player's lost wager is moved from the player's wager area 16 to the decision area 20 in front of the player. This lost wager is, in essence, inventoried, in the decision area 20 until the determination of the outcome for the next hand of play. Thus, during a hand of play, lost wagers are moved to the decision area 20 and winning outcomes are paid to the winning players. Push outcomes result in no action regarding the player's wager, i.e. it is neither moved to the decision area 20 nor is there an award to the player.

The players are then invited to participate in the next hand of play. The next hand of play is then played in the traditional fashion based upon the rules of the game. The method preferably requires the players with inventoried wagers in the decision area 20 to wager the same or greater amount that the amount inventoried. The wagers and inventoried lost wagers are then resolved according to the following rules:

1. Players with Inventoried, Lost Wagers, at Risk in Decision Area.

For these players, if they have lost the present, e.g. current, hand of play, the inventoried lost wager in the decision area 20 (lost in the previous hand of play) is collected by the dealer and the player's lost wager for the present hand of play is moved to the decision area 20. If the player has won the hand, the inventoried lost wager is returned to the player and the player is paid 1:1 for the wager for the present hand of play. If the present hand is a push, there is no action on either the present hand wager or the inventoried, lost wager in the decision area. Thus for a player to lose their wager, they must lose two consecutive hands. If the player loses a hand but wins the next hand, it is as if the previous loss has been converted to a push. Preferably, the amount of any wager for a hand of play must be the same as any inventoried wager at risk.

2. Players With No Inventoried Wagers at Risk in the Decision Area

For these players, if they lose their current wager, the lost wager moves to the decision area 20. If the player has a winning outcome, the player is paid 1:1 on their wager. For a tie outcome, the hand is declared a push.

Trump Card Blackjack

According to the method of this embodiment, each player makes a wager and the game is played according to the rules of the Blackjack game. Two cards are dealt to each player and to the dealer in the usual, known, manner, e.g one card face down to the dealer. According to the present invention, in addition to the two cards for the dealer, a trump card is dealt and displayed, the card suit of which defines the trump suit for the hand. Each player completes their hand according to the rules of the game, as does the dealer and the hands are compared, also according to the rules of the game. If the dealer has a higher hand value than the player, the player loses their wager. Conversely, if the player has a higher hand value, the player wins and is paid 1:1. If the player has a Blackjack, they are paid 3:2 or some other amount greater than 1:1, e.g. 6:5. In the event of a push, the player neither wins nor loses; however, in the event the player's final hand includes a card of the trump suit and the dealer's final hand does not contain a trump card, the player wins the push hand and is paid even money. In the event both the player and the dealer have trump cards in their push hands, the hand can be declared a push or the hand with the higher value trump card declared the winner. Still further, the trump aspect may be confined to only certain push holdings such as where the dealer and the player both have a Blackjack or to where the player's push hand contains two or more trump cards.

The trump variation can be played in traditional Blackjack to eliminate or reduce the number of pushes or can be incorporated into any of the games described above.

A jackpot component can be added to the game based upon the trump card concept. Table 1 below shows an example for a jackpot component for the game. The pays for each jackpot outcome may be altered to configure the overall vigourish for the game. To participate in the jackpot component, it may be required that the player make a separate, side wager.

TABLE 1

| Outcome | Jackpot |
|---|---|
| 6 trump cards totaling 21 | Progressive Jackpot |
| 5 trump cards totaling 21 | $2000–$3000 |
| 5 trump cards totaling 20 | $1000–$2000 |
| 4 trump cards totaling 21 | $750 |
| 4 trump cards totaling 20 | $500 |
| 3 trump cards totaling 21 | $250 |
| 3 trump cards totaling 20 | $200 |
| 2 trump cards totaling 21 | 2:1 |
| 2 trump cards totaling 20 | 1:1 |

Blackjack Plus More

According to this embodiment of the game, the player makes two initial wagers to participate in the game; one allocated to a Blackjack component and the other allocated to a Stud Poker component. The casino may dictate that the wagers are the same amount; however the amounts may be different as desired. The dealer then deals two cards to each player and to himself, with one of the dealer's cards dealt face up.

1. The Blackjack Component

The Blackjack component of this embodiment is played in the traditional fashion or may be played according to modified games as known in the art or as described above. For purposes of the description of the game it shall be assumed that the Blackjack component is played in the traditional fashion as is well known in the art. Each player, in turn, completes their hand by standing, splitting, doubling down, drawing additional cards, taking insurance or surrendering, as is well known. If the player's hand count exceeds 21, they bust and lose their Blackjack component wager. Unlike traditional Blackjack, however, the cards of busting players are not removed from play. Otherwise-each player stands on a hand of two or more cards have a summed value, according to the rules of Blackjack, of "21" or less. The dealer then completes his hand, in the traditional fashion. The dealer, by house rules, may be compelled to hit a soft 17 or less and stand on a hard 17 or higher. If the dealer's hand value exceeds "21", he busts and all players remaining in the game (have not previously busted) win. Otherwise, the dealer compares his hand count to that of the remaining players and as between each player and the dealer, the one with the higher hand value wins. Tie values are pushes. The dealer, in turn, removes all the player's Blackjack wagers by collecting those Blackjack wagers of losing players and paying the wagers for the winning players. The pay may be 1:1 for player winning hands and 3:2 for Blackjacks (Ace with a 10-value card).

After completion of the Blackjack component of the game, the dealer deals cards to each player to a stud poker hand having a count of five or more cards. That is, if a player received 5 or more cards during the Blackjack component, he/she would not receive and additional cards. If a player used 4 or fewer cards in the Blackjack hand, he/she would be deal sufficient cards to bring his/her card total to five.

To win the Poker wager, the player's Poker hand must have a predetermined Poker holding such as a pair of 5s or better. A pay table provides for various pays for different Poker holdings with the highest pay being, for example, a straight flush, five card flush, Royal flush or the like. For any player making the Poker wager and having a winning holding, the player is rewarded on the wager based on the pay table.

After resolution of the Poker component, all cards are collected.

The Poker component can be played in various formats such as deuces wild, Jokers wild (by adding a non-value Joker to the deck of cards, Joker and deuces wild or the like.

The Poker component can also be played where the dealer deals exposes a card, the suit of which defines a trump for the play of the Poker component. The pay table would reflect ceratin pays, for example, a trump suit straight flush, or pays for certain trump card holdings.

Russian Blackjack

According to this game method, the traditional rules of Blackjack apply. That is the target values for the game is a count of "21", players may split, double down, take insurance, surrender or the like. Certain restrictions may be applied as established by the casino, e.g. when players may split, double down, splitting of Aces and the like.

This game method differs in that face cards, usually valued at "110", are assigned different values. For example, Table 2 shows some variations of the values which may be assigned to the face cards.

TABLE 2

| Face Card | Ex 1 | Ex 2 | Ex 3 | Ex 4 |
|---|---|---|---|---|
| King | 4 | 5 | 6 | 7 |
| Queen | 3 | 4 | 5 | 6 |
| Jack | 2 | 3 | 4 | 5 |

Other values may be assigned.

The assigning of values other than "10" to the face cards has several affects on the game of Blackjack. There will be fewer final hand counts of "20" and "21", there will be fewer hands which bust (exceed a hand count of "21" and the like. Thus an initial holding of K Q according to example 1, would yield a hand count of 4+3=7. The player may then decide to hit, stand or the like.

The foregoing game methods may be incorporated into electronic games including a game processor to control player action according to the methods, a device for accepting a wager, device for paying a winning outcome, and a device for the player to control the action. The control device may include a touch display screen, keyboard, mouse or electronic actuator buttons.

It is to be understood that the present invention is subject to many modifications and changes without departing form the spirit and scope of the appended claims.

I claim:

1. A method for playing a modified Blackjack game between a dealer and at least one player using a standard deck of 52 playing cards where (i) each player makes a wager to participate in the game (ii) at least two playing cards are initially distributed to the dealer, one face up, and (iii) at least two playing cards are initially distributed to each player, the method comprising:

assigning to the playing cards values wherein 10–King are valued at ten points, Aces are valued at eleven points and all other cards have their face value;

each player completing their hand to a final holding by one of the following steps (i) passing wherein the player will use the initially distributed cards as his final holding, the summed values of the cards defining a final player hand value or (ii) swapping wherein the player discards at least one of his initially distributed cards and receives a replacement therefor defining the final holding, the summed values of the cards defining a final player hand value;

the dealer completing his hand to a final value by (i) exposing his face down card defining a final hand, the summed values of the cards defining a final dealer hand value and (ii), if the initially distributed cards have a summed value less than a predetermined sum, the dealer swapping the lowest value card for a dealt replacement card to define a final holding, the summed values of the cards defining a final dealer hand value; and comparing the dealer and player final hand values and (i) if the dealer has a higher final hand value, the player losing his wager(s), (ii) if the player has a higher hand value, issuing an award to the player and (iii) if the player's final holding is a pair of Aces, issuing the player a greater award.

2. The method of claim 1 comprising dealing two cards to each of the dealer and the player as said initially distributed cards and the player, if the player initial holding is a pair, opting to (iii) double his wager and spit his pair into two hands, the dealer dealing an additional card to the player which is summed with the card of both hands to define a final hand value for each hand.

3. A method for playing a modified Blackjack game between a dealer and at least one player using a standard deck of 52 slaving cards where a player places a wager and at least two cards are dealt to the dealer and the player defining an initial holding for each, with at least one of the dealer's cards dealt face down, the method comprising:

the player and dealer completing each of their hands to a final holding according to the rules of Blackjack;

the dealer dealing a trump card, the suit of which defines a trump;

comparing the player and dealer final holdings according to the rules of Blackjack and where the dealer and the player have a push holding outcome, resolving the push outcome according to one of the following (i) if the player's hand includes at least one card of the trump suit and dealer's does not, the player's hand declared the winner, (ii) if the dealer's hand includes at least one card of the trump suit and the player does not, the dealers hand declared the winner and the player's wager is lost, (iii) if the player and dealer final hands both have cards of the trump suit declaring the hand with the highest ranking card of the trump suit the winner.

4. The method of claim 3 comprising issuing an award to the player if the player final hand includes one of a schedule of holdings including trump suit cards.

5. The method of claim 4 comprising issuing an award to the player if the player final hand includes one of a schedule of holdings including trump suit cards according to the following schedule, Outcome 6 trump cards totaling 21

5 trump cards totaling 21

5 trump cards totaling 20

4 trump cards totaling 21

4 trump cards totaling 20

3 trump cards totaling 21

3 trump cards totaling 20

2 trump cards totaling 21

2 trump cards totaling 20.

6. The method of claim 4 comprising issuing an award to the player if the player final hand includes one of a schedule of holdings including trump suit cards according to the following schedule,

| Outcome | Award |
|---|---|
| 6 trump cards totaling 21 | Progressive Jackpot |
| 5 trump cards totaling 21 | $2000–$3000 |
| 5 trump cards totaling 20 | $1000–$2000 |
| 4 trump cards totaling 21 | $750 |
| 4 trump cards totaling 20 | $500 |
| 3 trump cards totaling 21 | $250 |
| 3 trump cards totaling 20 | $200 |
| 2 trump cards totaling 21 | 2:1 |
| 2 trump cards totaling 20 | 1:1. |

7. The method of claim 4 comprising the player making a second wager to be eligible for said an award to the player if the player final hand includes one of a schedule of holdings including trump suit cards.

8. A method for playing a modified Blackjack game between a dealer and at least one player using a standard deck of 52 playing cards where the player makes a hand wager to participate in the game, two cards are dealt to the dealer and the player to define an initial holding for each, with at least one of the dealer's cards dealt face down, the dealer and each player completing their hands according to rules of the game, the method comprising:

where the player loses the hand, the lost wager moved to a different location on the table and defining an inventoried loss wager;

on the following hand of play, the player making another hand wager (i) if the dealer wins said following hand of play, (a) said inventoried loss wager is collected by the dealer and (b) the hand wager is moved to said location as a new inventoried loss wager, (ii) if the player wins, the player's inventoried lost wager returned to the player and the player paid for the hand wager, and (iii) if the player and dealer push declaring no action on the inventoried lost wager and hand wager.

9. A method for playing a modified Blackjack game between a dealer and at least one player using a standard deck of 52 playing cards where (i) each player makes a wager to participate in the game (ii) at least two playing cards are initially distributed to the dealer, one face up, and (iii) at least two playing cards are initially distributed to each player, the method comprising:

assigning to the playing cards values wherein Jack–King are valued at one according to the criteria of, Jack=X Queen=X+1

King=X+2 and $2 \leqq X \leqq 5$;

all other cards of the deck valued according to the rules of Blackjack;

each player and dealer completing their hands according to the rules of Blackjack using said assigned values; and resolving the players wager according to the rules of Blackjack.

* * * * *